US005557308A

United States Patent [19]

Chandrasekaran

[11] Patent Number: 5,557,308

[45] Date of Patent: Sep. 17, 1996

[54] INK JET PRINT HEAD PHOTORESIST LAYER HAVING DURABLE ADHESION CHARACTERISTICS

[75] Inventor: Karuppiah Chandrasekaran, Sayre, Pa.

[73] Assignee: E. I. Du Pont de Nemours and Company, Wilmington, Del.

[21] Appl. No.: 272,363

[22] Filed: Jul. 8, 1994

[51] Int. Cl.[6] ..... B41J 2/05; B41J 2/03

[52] U.S. Cl. ..... 347/65; 347/71

[58] Field of Search ..... 347/63, 64, 65, 347/71

[56] References Cited

U.S. PATENT DOCUMENTS

| | | | |
|---|---|---|---|
| 4,221,646 | 9/1980 | Finelli et al. | 204/159.19 |
| 4,609,427 | 9/1986 | Inamato et al. | 347/65 |
| 4,937,172 | 6/1990 | Gervay | 430/280 |
| 4,968,582 | 11/1990 | Tranjan et al. | 430/270 |
| 5,073,462 | 12/1991 | Gervay | 430/14 |
| 5,288,589 | 2/1994 | McKeever et al. | 430/262 |

FOREIGN PATENT DOCUMENTS

| | | | |
|---|---|---|---|
| 5-278222 | 10/1993 | Japan | B41J 2/05 |

*Primary Examiner*—Valerie A. Lund

[57] ABSTRACT

The ink jet print head has a sandwich structure of a top plate, a bottom plate, and a dry film photoresist intermediate layer that defines liquid pathways and discharge orifices. The photoresist layer contains a phosphorus compound having substituted or unsubstituted alkyl or aryl groups having 6 to 10 carbons. The ink jet print head photoresist layers containing these phosphorus compounds exhibit durable bonds to the top and bottom plates of the print head and excellent ink resistance.

7 Claims, No Drawings

INK JET PRINT HEAD PHOTORESIST LAYER HAVING DURABLE ADHESION CHARACTERISTICS

FIELD OF THE INVENTION

This invention relates to ink jet print heads, and more particularly resin layers having improving adhesion to the top and bottom plates of the print heads.

Ink jet print heads are sandwich structures having top and bottom plates, and a dry film photoresist intermediate layer that defines liquid pathways and discharge orifices. The top plate contains the ink nozzles, and typically is made of a noble metal, glass or plastic. The bottom plate typically is a thermally stable substrate, such as a silicon wafer, that bears microcircuits. Microresistors are mounted on the substrate, projecting into the liquid pathways in the photoresist layer, in alignment with the ink nozzles. At computer command, the resistors superheat nearby ink, creating a steam bubble that forces ink droplets out the nozzles.

The dry film photoresist layer must meet many demanding requirements. It must be capable of being imaged to the fine resolution needed to define the ink passageways. The layer must be dimensionally stable (e.g., not swell) and capable of withstanding chemical attack from the hot aqueous inks, which typically have high pH and contain organic components. Moreover, the layer must remain firmly bonded to the top and bottom plates, which frequently are constructed of materials difficult to bond to (e.g., gold), during millions of firing cycles, despite stresses that tend to cause delamination.

Various photoresist materials have been proposed to meet the demanding requirements of print head construction. For example, Japanese Patent Application 5-278222, published Oct. 26, 1993, discloses a dry photoresist film containing a half acryloyl ester of a bis-phenol A epoxy monomer, a photoinitiator, and a polymeric binder that is said to be particularly useful for this purpose. Vacrel® solder mask material, a photoresist material sold by E. I. du Pont de Nemours and Company that contains acrylic and melamine monomers, photoinitiator, and an acrylic binder with acidic functions for water-based development, also has been used for this purpose. While these dry film photoresists have proven useful, further improvements are desired to achieve the desired durability for extended use of ink jet print heads.

SUMMARY OF THE INVENTION

It now has been found that the addition of certain phosphorus compounds to dry film photoresists used in ink jet print heads will improve durability of the print heads. Accordingly, the present invention provides, in an ink jet print head having a top plate, an intermediate photoresist layer defining ink passageways, and a bottom plate, the improvement wherein durability of the print head is improved by the presence of a phosphorus compound in the photoresist layer, said phosphorus compound having the formula:

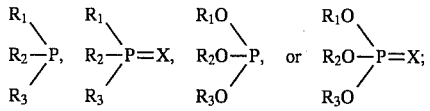

wherein $R_1$, $R_2$ and $R_3$ are substituted or unsubstituted aryl groups having 6 to 10 carbon atoms, and X is oxygen or sulfur.

DETAILED DESCRIPTION OF THE INVENTION

While the details of print head design will vary with the manufacturer, the print head generally has a top plate, an intermediate photoresist layer, and a bottom plate. The intermediate photoresist layer is a dry film that is imaged during the manufacturing process, followed by removal of non-exposed regions of the photoresist, to form ink passageways. It is critical that the photoresist layer remain firmly bonded to the top and bottom layers of the print head during extended use, and be resistant to chemical attack or swelling by the inks, which are aqueous based and typically contain organic components.

BOTTOM PLATE

The bottom plate serves as a mounting platform for microresistors or other elements used to generate pressure to discharge the ink, such as heat generating or piezo elements. The bottom plate typically is constructed of silicon, glass, ceramic, plastic or metal. Sputter-coated "passivation" layers may be employed to protect circuits mounted on the bottom plate from ink attack. For example, passivation layers of $Si_3N_4$ and SiC are shown in U.S. Pat. No. 4,809,428. Other inorganic oxide or inorganic nitride materials useful for this purpose are $SiO_2$, $Ta_2O_5$, $Al_2O_3$, glass, BN, etc.

The bottom plate also may be coated with a metal protective layer to impart ink resistance, either with or without a passivation layer. Anti-corrosive metals such as Ti, Cr, Ni, Ta, Mo, W, Nb and the like may be selected for this purpose, or alloys such as stainless steel or novel metals. Noble metals such as gold, paladium or platinum also may be selected, but are more difficult to bond to the photoresist layer.

PHOTORESIST LAYER

The photoresist layer may be applied to the bottom plate either in liquid form, then dried, or preferably as a dry film. The photoresist layer contains a monomer, binder, photoinitiator, and phosphorus compound in accordance with this invention. Other additives may be present to modify the properties of photopolymer materials. Particularly preferred composites are disclosed in U.S. Pat. No. 4,937,172, incorporated herein by reference, and are composed of a monomer that is a half acryloyl ester of bisphenol A epoxy; a photoinitiator system; and a macromolecular elastomeric water-insoluble binder.

Phosphorus Compound

The phosphorus compound included in the photoresist layer has the formula:

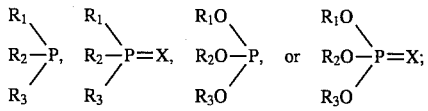

wherein $R_1$, $R_2$ and $R_3$ are substituted or unsubstituted aryl groups having 6 to 10 carbon atoms, preferably phenyl or substituted phenyl, and X is oxygen or sulfur. Representative substitute groups are chloride, bromide, iodide, nitrile, hydroxy, alkyl, and alkoxy.

Representative compounds that may be selected in practicing the invention include triphenyl phosphine, tricresyl phosphine, triphenyl phosphate, triphenyl phosphine sulfide, triethylphosphine oxide, trimethyl phosphine, tris(chloromethyl) phosphine, tris(trichloromethyl) phosphine, tripentyl phosphate, triethyl phosphate, trimethyl phosphite, triethyl phosphite, and triphenyl phosphite. The phosphorus compound will be present in the amount of 0.01 to2%, preferably 0.05 to 0.5%, by weight based on total weight of the photoresist layer. Photoresist layers containing these phosphorus compounds exhibit durable bonds to the top and bottom plates of the print head, improved shelf life, and excellent ink resistance Monomers Conventional monomers used in photosensitive resist compositions may be selected in practicing the invention. The selected monomer will contain at least two ethylenically unsaturated groups capable of undergoing polymerization upon exposure to actinic radiation. Excessive amounts of trifunctional acrylate monomers should be avoided as it may cause undue reduction in flexibility.

Suitable monomers which can be used as the sole monomer, or used in combination with others, include acrylate and methacrylate derivatives of alcohols, isocyanates, esters, epoxides and the like. Examples are diethylene glycol diacrylate, trimethylolpropane triacrylate, pentaerythritol triacrylate, polyoxyethylated and polyoxypropylated trimethylolpropane triacrylate and trimethacrylate and similar compounds as disclosed in U.S. Pat. No. 3,380,831, di-(3-methacryloxy-2-hydroxypropyl) ether of tetrachlorobisphenol-A, di-(2-methacryloxyethyl) ether of tetrachlorobisphenol-A, di-(3-methacryloxy- 2-hydroxypropyl) ether of tetrabromobisphenol-A, di-(2-methacryloxyethyl) ether of tetrabromo-bisphenol-A, triethylene glycol dimethacrylate, trimethylol propane triacrylate, polycaprolactone diacrylate, and aromatic urethane oligomeric di(meth) acrylates such as those sold by Sartomer, West Chester, Pa.

A particularly preferred class of comonomers is hexamethylene glycol diacrylate, triethylene glycol diacrylate, tripropylene glycol diacrylate, trimethylolpropane triacrylate, polyoxyethylated trimethylolpropane triacrylate, polyoxypropylated trimetholpropane triacrylate, pentaerythritol tri- and tetracrylate, bisphenol-A diacrylate, di-(3-acryloxy-2-hydroxypropyl) ether of bisphenol-A, di-(3-acryloxy-2-hydroxypropyl) ether of tetrabromo-bisphenol-A, or methacrylate analogues thereof as well as aliphatic urethane diacrytates such as those sold by Sartomer, and aromatic urethane diacrylates available from Sartomer, West Chester, Pa.

The monomer(s) typically will constitute 5 to 50%, preferably 20 to 40%, by weight of the total weight of the photoresist layer.

Binders

Suitable binders which can be used as the sole binder, or in combination with others, include the following: polyacrylate and alpha-alkyl polyacrylate esters (e.g., polymethyl methacrylate, polyethyl methacrylate, polybutyl methacrylate and polyhexyl methacrylate); copolymers and terpolymers of isobornyl acrylate, hydroxyethyl methacrylate, and butane diacrylate; copolymers of glycidyl ethers with the above mentioned monomers; polyvinyl esters (e.g., polyvinyl acetate, polyvinyl acetate/acrylate, polyvinyl acetate/methacrylate and hydrolyzed polyvinyl acetate); ethylene/vinyl acetate copolymers; polystyrene polymers and copolymers; saturated and unsaturated polyurethanes; synthetic rubbers (e.g., butadiene/acrylonitrile, acrylonitrile/butadiene/styrene and/or bromostyrene, methyl methacrylate/acrylonitrile/butadiene styrene copolymers, 2-chlorobutadiene/1,3-polymers, and styrene/-butadiene/styrene, styrene/isoprene/styrene block copolymers); polybromostyrene; polyethylene oxides of polyglycols having average molecular weights from about 4,000 to 1,000,000; epoxides (e.g., epoxides containing acrylate or methacrylate groups); copolyesters, e.g., those prepared from the reaction product of a polymethylene glycol of the formula $HO(CH_2)_nOH$, where n is a whole number 2 to 10 inclusive, and (1) hexahydroterephthalic, sebacic and terephthalic acids, (2) terephthalic, isophthalic and sebacic acids, (3) terephthalic and sebacic acids, (4) terephthalic and isophthalic acids, and (5) mixtures of copolyesters prepared from said glycols and (i) terephthalic, isophthalic and sebacic acids and (ii) terephthalic, isophthalic, sebacic and adipic acids; nylons or polyamides, e.g., N-methoxymethyl polyhexamethylene adipamide; cellulose esters, e.g., cellulose acetate, cellulose acetate succinate and cellulose acetate butyrate; cellulose ethers, e.g., methyl cellulose, ethyl cellulose and benzyl cellulose; polycarbonates; polyvinyl acetal, e.g., polyvinyl butyral, polyvinyl formal; polyformaldehyde. The composition may also contain a preformed macromolecular elastomeric polymer binder similar to that disclosed in U.S. Pat. No. 4,937,172.

The binder(s) typically will constitute 15 to 50%, preferably 20 to 40%, by weight of the total weight of the photoresist layer.

Photoinitiator

Conventional photoinitiators, or photoinitiator systems, may be selected in practicing the invention. The initiator directly furnishes free radicals when activated by actinic radiation. A sensitizer also may be present, typically to extend spectral response into the near ultraviolet, visible, and near infrared spectral regions.

Sensitizers which improve photospeed when used in combination with the phosphorous containing compound include the bis(p-dialkylaminobenzylidene) ketones disclosed in Baum et al., U.S. Pat. No. 3,652,275, and the arylidene aryl ketones disclosed in Dueber, U.S. Pat. No. 4,162,162. Some other initiators which improve photospeed when used in combination with the phosphorous containing compound include hydrogen donor compounds that function as chain transfer agents in the photopolymer compositions include: 2-mercaptobenzoxazole, 2-mercaptobenzothiazole, 4-methyl-4H- 1,2,4-triazole-3-thiol, etc.; as well as various compounds disclosed in column 12, lines 18 to 58 of MacLachlan, U.S. Pat. No. 3,390,996. Suitable hydrogen donor compounds for use in systems containing both biimidazole type initiator and N-vinyl carbazole are 5-chloro-2-mercaptobenzothiazole; 2-mercaptobenzothiazole; 1H-1,2,4-triazole- 3-thiol; 6-ethoxy-2-mercaptobenzothiazole; 4-methyl-4H-1,2,4-triazole-3-thiol; 1-dodecanethiol; and mixtures thereof.

Preferred photoinitiator systems, which improve photospeed alone or in combination with the phosphorous containing compound, include 2,4,5-triphenylimidazolyl dimers in combination with chain transfer agents, or hydrogen donors, such as those disclosed in U.S. Pat. Nos. 3,479,185; 3,784,557; 4,311,783; and 4,622,286. Preferred hexaarylbiimidazoles (HABI) are 2-orthochlorosubstituted hexaphenylbiimidazoles in which the other positions on the phenyl radicals are unsubstituted or substituted with chloro, methyl or methoxy. The most preferred initiator is ortho-Cl-HABI, i.e., 1,1'-biimidazole, 2,2'-bis(orthochlorophenyl)-4,4',5,5'-tetraphenyl-imidazole dimer.

A large number of free-radical generating compounds, including redox systems such as Rose Bengal/2-dibutylaminothanol, may be selected to advantage. Sensitizers useful with photoinitiators include methylene blue and those disclosed in U.S. Pat. Nos. 3,554,753; 3,563,750; 3,563,751; 3,647,467; 3,652,275; 4,162,162; 4,268,667; 4,351,893; 4,454,218; 4,535,052; and 4,565,769.

A particularly preferred class of photoinitiators and photosensitizers, which improve photospeed when used in combination with the phosphorous containing compound, are benzophenone, Michler's ketone, ethyl Michler's ketone, p-dialkylaminobenzaldehydes, p-dialkylaminobenzoate alkyl esters, polynuclear quinones, thioxanthones, hexaarylbiimidazoles, cyclohexadienones, benzoin, benzoin dialkyl ethers, or combinations thereof where alkyl contains 1 to 4 carbon atoms.

The photoinitiator, or photoinitiator system, typically will constitute 0.5 to 10%, preferably 2 to 5%, by weight of the total weight of the photoresist layer.

Additives

Conventional additives incorporated in photosensitive compositions may be included. For example, the photoresist may contain thermal polymerization inhibitors such as p-methoxy phenol, hydroquinone and alkyl and aryl-substituted hydroquinones and quinones, tertiary butyul catechol, pyrogallol, copper resinate, naphthylamines, beta-naphthol, cuprous chloride, 2,6-di-ter-butyl-p-cresol, phenothiazine, pyridine, nitrobenzene, dinitrobenzene, p-toluquinone and chloranil. Also useful as thermal polymerization inhibitors are the nitroso compositions disclosed in U.S. Pat. No. 4,168,982. Various dyes and pigments may be added to increase the visibility of the resist image, provided the dye or colorant is transparent to the actinic radiation used to create the ink channels in the photoresist layer.

Thickness

Thickness of the resin layer can range widely, in accordance with design requirements. U.S. Pat. No. 4,970,532, for example, discloses a thickness range of 20 to 200 microns. Variation from the desired thickness, however, must be minimized to maintain consistent ink drop volumes from each nozzle. U.S. Pat. No. 4,994,826 discloses a maximum tolerance of +/−5% of resin layer thickness. Dry film photoresist materials offer consistent thickness in high volume over liquid resists and eliminate the costs of constant wafer-to-wafer quality assurance programs associated with spin-cast liquid resists.

The negative resin layers or resist materials are capable of aspect ratios of about 1.5 to 5 (i.e., 10 micron channels can be produced from films as thick as about 50 microns). Narrower channels can be produced with proportionately thinner films. Such resolution is dependent on several factors, such as the selected light source, photochemistry of the photoresist material, adhesion of the cured photopolymer to the first substrate, and selection of the development process, which includes the proper choice of developing liquid.

The resin layer is normally imaged with actinic radiation through a target which is registered with the underlying microresistors. Collimated light generally is used to obtain channel walls perpendicular to the bottom plate. Channel walls can be made either thinner or thicker at the top than at bottom, depending on the choice and balance of active ingredients.

The development process makes use of a difference in solubility of exposed and unexposed material. This difference in solubility can be maximized by the choice of developing liquid. The unexposed resist should show only moderate solubility in the developer. Solvents used for coating or stripping are generally too aggressive when used as developing solvents. When developing liquids are too aggressive, the photocured resist or resin layer tends to swell and peel from the substrate and development latitude is diminished.

Excessive stresses imposed during the development process can remove finer features of imaged resist or resin layer from the substrate and cause an apparent loss of resolution.

TOP PLATE

The top plate is then bonded, preferably laminated, to the developed photoresist layer. The top plate may have a support plate and a surface layer of a noble metal. Some examples of support plates include glass, ceramics, metal, plastics, thermoplastic resins such as acrylic resins, ABS resins, polyethylene and the like. Some examples of noble metals include gold, platinum, palladium and iridium.

PROCESS

The various print head manufacturing processes differ in how each of these general steps is done. In one embodiment, a noble metal-surfaced top plate may be aligned appropriately with features on the face of a bottom plate that bears printed microcircuits and an imaged and developed resin layer, and then bonded with the resin layer or resist surface using heat and pressure. After thermal curing, cooling, and cutting one or more ink jet print heads, with improved adhesion of the resist to the top and bottom plates, are produced.

EXAMPLES

The following examples, wherein parts and percentages are by weight, illustrate but do not limit the invention. All coatings were made onto polyethylene terephthalate support film and covered with a 1-sided matte or clear polyethylene unless otherwise noted.

GLOSSARY:

| | |
|---|---|
| Ebecryl ® 7600 resin | Aromatic Urethane Acrylate (Functionality 2.2) from Radcure |
| Yellow Chips | Yellow Dye in a Carrier |
| Cyan Chips | Cyan Dye in a Carrier |
| Paraloid ® BTA 717 resin | Methylmethacrylate/ Butadiene/Styrene Terpolymer from Rohm and Haas |
| Evalcite ® 2051 resin | Polymethylmethacrylate (Mw 150,000) from DuPont |
| Ethyl Michler's Ketone | 4,4'-Bis (Dimethylamino) Benzophenone |
| TMCH | (4-Methyl-4-Trichloromethyl-2,5-Cyclohexadienone) |
| LCV | Leuco Crystal Violet |
| TDMA | Triethylene Glycol Dimethacrylate (SR-205) from Sartomer |
| Ebecryl ® 3903 resin | Half Acrylated Bis Phenol a Diglycidel Ether from Radcure |
| TPP | Triphenylphosphine from Aldrich Co. |
| TMPTA | Trimethylol Propane Triacrylate |
| TMPTMA | Trimethylol Propane Trimethacrylate |
| o-Cl-HABI | 2,2'-Bis (Chlorophenyl)-4,4'5,5' - Tetraphenyl Biimidazole |

The samples were tested using the following tests:

Adhesion To The Top Plate:

The photopolymer film was laminated on a silicon wafer substrate which had circuitry and a passivation layer. The film was exposed through art work and then developed using a blend of n-methylpyrrolidone and diethylene glycol. The film was uv cured and the top plate was laminated onto the UV cured film. The sandwich structure was baked at 220° C. for a time between 30 to 60 minutes. The top plate was peeled using Instron equipment manufactured by Instron Corp., Springfield, N.J., and the peel force was determined.

Ink Resistance:

The photopolymer film was laminated on a silicon wafer substrate which had circuitry and a passivation layer. The film is exposed through an art work and then developed using a blend of n-methylpyrrolidone and diethylene glycol. The film was uv cured and the top plate was laminated on the UV cured film. The sandwich structure was baked at 220° C. for a time between 30 to 60 minutes. The top plate was peeled using Instron equipment manufactured by Instron Corp., Springfield, N.J., and the peel force was determined. The sample was immersed in ink at 70° C. for 3 weeks and the peel force to remove the top plate was determined using Instron as described earlier.

Example 1:

Samples A and B were prepared by coating the following compositions on a 24 micron thick polyethylene terephthalate substrate:

| INGREDIENT SAMPLE | AMOUNT (gms) A (Control) | B |
|---|---|---|
| Ebecryl ® 6700r esin | 30.0 | 30.0 |
| Paraloid ® BTA 717 resin | 85.6 | 85.6 |
| Elvacite ® 2051 resin | 56.4 | 56.4 |
| Cyan Pigments | 0.58 | 0.58 |
| Yellow Pigments | 0.28 | 0.28 |
| EMK | 0.32 | 0.32 |
| TMCH | 2.16 | 2.16 |
| LCV | 0.54 | 0.54 |
| Benzophenone | 9.0 | 9.0 |
| TDMA | 59.4 | 59.4 |
| Ebecryl ® 3903 resin | 47.28 | 47.28 |
| TPP | — | 0.70 |

Photospeed of the TPP containing sample B was 10.5 at 80 mJ whereas that of the control sample A was 8. For sample B, 15 micron wide, L-shaped lines adhered to the substrate surface after development whereas the control showed only 20 micron wide, L-shaped lines adhering to the substrate.

The samples were then tested for adhesion and ink resistance as described earlier. Baking the samples after UV exposure increased adhesion and subsequently improved resolution. When the samples laminated to the silicon wafer substrate were placed in the oven at 148.9° C. (300° F.) for 10 minutes sample B developed well and sample A (control) did not develop.

Example 2:

Four samples were prepared by coating the following compositions on 24 micron thick polyethylene terephthalate substrates:

| INGREDIENT | AMOUNT (gms) | | | |
|---|---|---|---|---|
| SAMPLE | A[1] | B | C | D |
| Paraloid ® BTA IIIF | 10.80 | — | — | — |
| Paraloid ® BTA 717 | — | 202 | 202 | 162 |
| Elvacite ® 2051 | 7.84 | 117.6 | 117.6 | 117.6 |
| TMPTA | 8.24 | 123.6 | 123.6 | 123.6 |
| Ebecryl ® 6700 | 4.16 | 62.4 | 62.4 | 62.4 |
| Ebecryl ® 3903 | 6.56 | 98.4 | 98.4 | 98.4 |

-continued

| INGREDIENT | AMOUNT (gms) | | | |
|---|---|---|---|---|
| SAMPLE | A[1] | B | C | D |
| Benzophenone | 1.67 | — | 25.0 | — |
| EMK | 0.06 | 0.9 | 0.9 | 0.9 |
| TMCH | 0.41 | 6.2 | 6.2 | 6.2 |
| LCV | 0.10 | 1.5 | 1.5 | 1.5 |
| Yellow Chips | 0.08 | 1.2 | 1.2 | 1.2 |
| Cyan Chips | 0.08 | 1.2 | 1.2 | 1.2 |
| TPP | — | 1.5 | 1.5 | 1.5 |
| O-Cl-HABI | — | 7.5 | — | 7.5 |
| RESOLUTION | 0.94 | 1.14 | 1.32 | 1.04 |
| MYLAR ® ADHESION | 958 | 963 | 358 | 1475 |

[1]Sample A is the Control

All samples showed acceptable adhesion to the polyethylene terephthalate substrate, but the resolution for the TPP containing samples B, C and D was better than control sample A.

Example 3:

Two samples were prepared by coating the following compositions from 25–40% solids solutions in acetone on to 24 micron thick polyethylene terephthalate substrates:

| INGREDIENT SAMPLE | AMOUNT (gms) A (Control) | B |
|---|---|---|
| Paraloid ® BTA IIIF | 10.80 | 10.80 |
| Elvacite ® 2051 | 7.84 | 7.84 |
| TMPTA | 8.24 | 8.24 |
| Ebecryl ® 6700 | 4.16 | 4.16 |
| Ebecryl ® 3903 | 6.56 | 6.56 |
| Benzophenone | 1.67 | 1.67 |
| EMK | 0.06 | 0.06 |
| TMCH | 0.41 | 0.41 |
| LCV | 0.10 | 0.10 |
| Yellow Chips | 0.08 | 0.08 |
| Cyan Chips | 0.08 | 0.08 |
| TPP | — | 0.10 |

The samples were tested for adhesion, and ink resistance as outlined earlier. Fresh control sample A resolved 50 micron spaces and dropped 40% after aging, with severe residues being apparent. Fresh and aged samples B containing TPP resolved 60 micron spaces. There were no residues with the fresh or aged samples. After thermal cycling, the control sample A showed 78% greater delamination than sample B. Adhesion of the photopolymer layer in sample B to a polyimide film (E. I. du Pont de Nemours and Company, Wilmington, Del.) after cure was 35% better than that of the control sample A. After conducting the ink resistance test, adhesion of sample B was found to be 40% better than control Sample A.

Example 4:

Five samples were prepared by coating the following compositions from 25–40% solids solutions in acetone on to 24 micron thick polyethylene terephthalate substrates:

| INGREDIENT | AMOUNT (gms) | | | | |
|---|---|---|---|---|---|
| SAMPLE | A[1] | B | C | D | E |
| Paraloid ® BTA 717 | 21.9 | 21.9 | 21.9 | 21.9 | 21.9 |
| Elvacite ® 2051 | 15.88 | 15.88 | 15.88 | 15.88 | 15.88 |
| TDMA | 16.72 | 16.72 | 16.72 | 16.72 | 16.72 |
| Ebecryl ® 6700 | 8.42 | 8.42 | 8.42 | 8.42 | 8.42 |

-continued

| INGREDIENT | AMOUNT (gms) | | | | |
|---|---|---|---|---|---|
| SAMPLE | A[1] | B | C | D | E |
| Ebecryl ® 3903 | 13.3 | 13.3 | 13.3 | 13.3 | 13.3 |
| Benzophenone | 2.53 | 2.53 | 2.53 | 2.53 | 2.53 |
| EMK | 0.08 | 0.08 | 0.08 | 0.08 | 0.08 |
| TMCH | 0.61 | 0.61 | 0.61 | 0.61 | 0.61 |
| LCV | 0.20 | 0.20 | 0.20 | 0.20 | 0.20 |
| Yellow Chips | 0.16 | 0.16 | 0.16 | 0.16 | 0.16 |
| Cyan Chips | 0.16 | 0.16 | 0.16 | 0.16 | 0.16 |
| TPP | — | 0.12 | — | — | — |
| TPP sulfide | — | — | 0.12 | — | — |
| Triphenyl phosphite | — | — | — | 0.12 | — |
| Triphenyl phosphate | — | — | — | — | 0.12 |

[1]Sample A is the control

The phosphorous compound containing samples showed higher photospeed at 25 mJ exposure. The samples were aged in an environmental oven at 40° C. at 70% RH for 30 days. The aged samples were laminated on the silicon wafer, exposed to UV light and developed using trichloroethane. The phosphorous containing samples developed cleanly whereas the control sample showed severe residues. These phosphorous containing samples are expected to show good ink resistance performance.

What is claimed is:

1. An ink jet print head having a top plate, an intermediate photoresist layer defining ink passageways, and a bottom plate, the improvement wherein a phosphorus compound is present in the photoresist layer in an amount of approximately 0.01 to 2% by weight, based on total weight of the layer, said phosphorus compound having the formula:

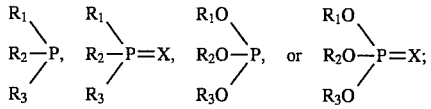

wherein $R_1$, $R_2$ and $R_3$ are substituted or unsubstituted alkyl groups, or substituted or unsubstituted aryl groups having 6 to 10 carbon atoms, and X is oxygen or sulfur.

2. The print head of claim 1 wherein at least one of said aryl groups is a substituted phenyl group containing a chloride, bromide, iodide, nitrile, hydroxy, alkyl or alkoxy group.

3. The print head of claim 1 wherein said phosphorus compound is selected from the group consisting of triphenyl phosphine, tricresyl phosphine, triphenyl phosphate, triphenyl phosphine sulfide, triethylphosphine oxide, trimethyl phosphine, tris(chloromethyl) phosphine, tris(trichloromethyl) phosphine, tripentyl phosphate, triethyl phosphate, trimethyl phosphite, triethyl phosphite, and triphenyl phosphite.

4. The print head of claim 3 wherein said phosphorus compound is present in the amount of approximately 0.05 to 0.5% by weight, based on the total weight of said photoresist layer.

5. The print head of claim 4 wherein said photoresist layer contains 15 to 50% binder, 5 to 50% monomer, and 0.5 to 10% photoinitiator, by weight.

6. The print head of claim 5 wherein said photoresist layer contains a half acryloyl ester of bis-phenol A epoxy monomer.

7. The print head of claim 5 wherein said photoresist layer contains a macromolecular elastomeric water-insoluble binder.

* * * * *